US006813470B1

(12) United States Patent
Elbert et al.

(10) Patent No.: US 6,813,470 B1
(45) Date of Patent: Nov. 2, 2004

(54) HIGH DENSITY FOAM ROLL

(75) Inventors: Donald L. Elbert, Lexington, KY (US); Michelle K. Morris, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/617,313

(22) Filed: Jul. 10, 2003

(51) Int. Cl.[7] ..... G03G 15/08; G03G 15/00
(52) U.S. Cl. ..... 399/381; 492/56
(58) Field of Search ..... 399/281, 176, 399/272, 273, 279, 283, 313; 492/53, 56, 48

(56) References Cited

U.S. PATENT DOCUMENTS 5,163,668 A * 11/1992 Winship et al. ..... 271/121
5,287,150 A 2/1994 Kinoshita et al.
5,311,264 A 5/1994 Kinoshita
5,597,652 A 1/1997 Utsunomiva et al.
5,768,668 A 6/1998 Shiraki et al.
5,855,818 A * 1/1999 Gan et al. ..... 252/511
5,923,934 A 7/1999 Hattori
5,930,570 A 7/1999 Saito et al.
5,953,569 A 9/1999 Ishikawa
6,026,265 A 2/2000 Kinoshita et al.
6,149,564 A 11/2000 Nozawa et al.
6,151,473 A 11/2000 Saito et al.
6,151,474 A 11/2000 Ichikawa et al.
6,194,478 B1 * 2/2001 Cox et al. ..... 521/189
6,196,958 B1 3/2001 Shiraki et al.
6,352,771 B1 3/2002 Chiang et al.
6,480,692 B2 11/2002 Yamazaki et al.

* cited by examiner

*Primary Examiner*—Quana Grainger
(74) *Attorney, Agent, or Firm*—Dinsmore & Shohl, LLP

(57) ABSTRACT

A roll comprising polymeric foam having a density of at least about 6 pounds per cubic foot and a compression force deflection of at least about 2.5 pounds per square inch. The roll may be used in image forming devices, and may be specifically employed as a toner added roll in electrophotographic image forming devices for toner applications.

25 Claims, 1 Drawing Sheet

HIGH DENSITY FOAM ROLL

FIELD OF THE INVENTION

The present invention relates to high density foam rolls suitable, for example, for transporting and applying toner in an image-forming apparatus such as an electrophotographic printer. Additionally, the invention relates to polyurethane foam toner adder rollers exhibiting high density and stiffness, and to methods for applying toner in print media applications using the same. Further, the invention relates to image-forming apparatuses comprising high density foam rollers.

BACKGROUND OF THE INVENTION

In a typical image forming apparatus, including but not limited to copiers, recorder, printers, and facsimile receptors, an image formed on a photoconductive image-bearing medium is developed by an image-developing device into a visible image by transfer of a toner (developer) to selected local spots on the imagewise exposed image bearing medium. The image developing device typically comprises a toner-containing case, an image developing roll, and a toner adder roll. A toner adder roll, also referred to as a toner supply roll, is typically an elastic roll adapted to supply the toner to the developing roll, which then transfers the toner to the image-bearing medium. The toner adder roll must be capable both of supplying a suitably controlled amount of the toner to the developing roll, and scrubbing off unused toner from the developing roll, so that the toner is uniformly distributed on the developing roll. The toner adder roll and developer roll have the same rotational direction with respect to one another and there is typically a nip at the contact area between the toner roll and the developing roll. Hence, the toner roll and developing roll are moving in opposite directions at the nip in order to effect the scrubbing and toner-supply functions.

Several features of the toner adder roll are important to its proper functioning in the dual capacity of both application and removal of toner. Scrubbing ability is enhanced by increasing hardness, contact pressure at the nip, and surface roughness. Excessive hardness, however, may lead to undesirable accelerated wearing of the developer roll, deterioration due to grinding of the toner particles, and excessive electrostatic charging of the toner. This eventually results in deterioration in the quality of the reproduced image.

Typically, then, toner adder rolls are formed of flexible polymeric foams. However, such foams exhibit inherently low electrical conductivity, and, therefore, resistivity and static discharge must be controlled via conductive agents incorporated in the roll. Open cell, reticulated foams have historically been preferred for toner adder rolls because they exhibit the necessary flexibility and surface roughness, and can easily be made conductive by exposing the foam to aqueous dispersions comprised of suitably conductive agents such as carbon black, and a resin binder. Described in greater detail below, an open-cell structure is generally defined as one in which the cells communicate with one another. A reticulated cell structure represents the extreme form of open-cell structures, and formation requires an additional step comprising subjecting the foam to high pressure and temperature, or by a chemical process, such that the cell membranes between the cells are eliminated, and all that remains is a cellular skeletal matrix. The reticulated cell structure, disclosed in U.S. Pat. No. 4,985,467, to Kelly et al., has been considered ideal for toner adder rolls because it is highly permeable to liquid-agent dispersions, and readily allows the dispersion to penetrate and thereby coat the internal foam structure.

One well-known problem with many conventional image-developing devices arises from gradual hardening of the toner adder roll. In a developing device using a toner adder roll made of a reticulated foam material, toner enters the cells of the foam material through the surface cells on the peripheral portion of the adder roller which contacts the developing roll. Large cellular size, lack of cellular membranes and ease of inter-cellular flow results in gradual accumulation of toner in the interior of the roll, hardening the roll excessively over time. As a result of the hardening, the contact pressure of the adder roll to the developing roll increases. Accordingly, the toner fuses on the developing sleeve, deteriorates, and the driving torques for the developing sleeve and the toner adder roll increase. The hardening is not uniform in the longitudinal direction of the adder roll, and, therefore, toner is not uniformly supplied to or scrubbed from the developing roll. Hence, the triboelectric charge of the toner on the developing roll is non-uniform, and the toner layer thickness on the roll is non-uniform.

These types of foam have proven satisfactory for monochrome print applications. However, it has been found that the use of such foams in color applications contributes to significant print variation problems, specifically a problem known in the printer industry as "fade to color" wherein there is a band of light print at the top of a page of solid area print with a width corresponding to the first revolution of the developer roll.

Toner-related problems are generally exacerbated when color toner is used. Color toner typically has fluidity inferior to that of black toner. Specifically, color toner contains a resin of a type having a multiplicity of low-molecular weight components in order to realize color transmissivity and a dispersant for uniformly dispersing color pigment. An electrophotographic process using color toner typically comprises four developing devices, which would require a substantial increase in the size of the image-forming apparatus over that forming a monochrome image. To keep the size of the apparatus consistent with that required by monochrome processes, the size of the developing device is decreased, and the density of pigment in each toner particle is typically increased to produce a required image density with a smaller quantity of toner, hence allowing the capacity of the toner case to be reduced. This increase in the pigment component also deteriorates the fluidity of the toner, causing a greater rotational load, changing the torque, with resulting jitters in the formed image. Increasing the pigment component also raises the surface area ratio of the pigment component on the toner particle surface in general. Toner generally has a certain polarity and is frictionally charged by an electrified member having a polarity opposite to the polarity of the toner (such as the developing roll), so that the charging of toner is stabilized. When the toner particles have a large surface area of pigment, the electrified members, such as the developer roll, encounter filming attributable to mechanical contact and sliding. The charged characteristic of toner deteriorates and becomes unstable.

Conventional toner tends to have a relatively small particle size and relatively low melting point, so as to meet demands for improved image quality during increased speed of printing. Toner of this size tends to aggregate due to electrostatic charging, and the aggregate masses can form films of toner on the outer circumferential surface of the developing roll, so that the remaining toner films cannot be sufficiently scrubbed off by the toner adder roll, leading to occurrence of undesirable variation of the toner concentration or density of the reproduced image.

In order to prevent the clogging and hardening of toner within the toner adder roll, several solutions have been proposed. For example, toner adder rolls with non-cellular skin layers for preventing the penetration of toner have been provided. However, this solution often results in an undesirable fog due to fusing of the toner particles to the developing roll surface caused by excessive contact between the toner adder roll and developing roll. Also, toner adder rolls comprised of higher density inflexible foams with open but smaller cells may result in decreased or nonexistent entry of toner into the roller, but, typically, the overall hardness of the roll is too high, negatively impacting scrubbing ability, and, like the skin-layered rolls, the greater contact surface between the toner adder roll and developing roll led to frictional fusing of the toner to the developer roll.

Toner adder rolls formed from closed cell foams have been disclosed, and hardening of the roll due to collection of the toner in the pores can be prevented. However, such foams typically have higher density, and, if the density of the roll is too high, it has been found that there arises the same problems as when the roll of the open-cell foamed material is hardened. In addition, the contact surface with the developer roll is undesirably increased such that frictional fusing of toner is likely to occur, as with the smaller-celled inflexible foams. The foam must be flexible enough to form a nip at the interface with the developing roll that is effective to scrub unused toner, and resilient enough to be deformed by compression at the nip, yet "spring back" to substantially its original diameter upon rotating past the nip so that effective engagement at the scrubbing side of the nip is maintained.

Toner adder rolls comprised of foams wherein an additional precision-foam contouring step is employed are known. The contouring step is often employed in order to provide the roll with an outer peripheral surface sufficiently irregular to provide the requisite scrubbing and avoid the fusing of toner associated with excessive contact between the toner adder roll and developing member. These rolls typically comprise periodic surface irregularities such as trapezoidal or helical protrusions. These rolls, however, are more expensive to manufacture. Further, they yield inconsistent scrubbing results and inconsistent triboelectric charging of the toner due to the roll diameter variance created by the presence of the protrusions.

Thus, it would be advantageous to provide a toner adder roll which overcomes the disadvantages of the prior art while providing features that confer functional requirements and advantages. Also, it would be advantageous to provide a toner adder roll with a surface effective both to supply and scrub toner and avoid excessive contact force at the nip. Finally, it would be advantageous to provide a toner adder roll specifically adapted to functioning with colored toner in multi-chrome image-forming applications, and to do so in a cost effective manner.

SUMMARY OF THE INVENTION

Accordingly, it is an object of the present invention to provide higher density foam rollers suitable for use, for example, in image-forming apparatuses. It is a further object to provide such rollers which overcome disadvantages of the prior art.

In one embodiment, the invention is directed to a roll for use in an image-forming apparatus comprising polymeric foam exhibiting a density of at least about 6 pounds per cubic foot (pcf), and a 25% compression force deflection (CFD) of at least about 2.5 pounds per square inch (psi).

In another more specific embodiment, the invention is directed to a toner adder roll for use in an electrophotographic image-forming apparatus comprising a substantially homogeneous layer of open-celled, non-reticulated polyurethane foam cylindrically disposed about a metal shaft. At least one conductive agent is dispersed throughout the foam and the foam exhibits a density of at least about 6 pcf, a 25% CFD of at least 2.5 psi, an average linear cell count of from about 90 to about 120 pores per inch (ppi), and a resistivity of less than about $1\times10^9$ ohm-cm.

The present invention is also directed to image-forming apparatuses, and, more specifically, to an electrophotographic image-forming apparatus, comprising the aforementioned rolls.

Further, the invention is directed to a method for applying toner to a developing member in an electrophotographic image-forming apparatus comprising applying the toner via a roll comprising polymeric foam wherein the foam exhibits a density of at least about 6 pcf and a 25% compression force deflection of at least about 2.5 psi.

The rolls, image-forming apparatuses and methods of the invention advantageously employ rolls which may be easily manufactured by methods well-known in the arts, and provide precise toner application in a relatively inexpensive manner. These, and additional objects, embodiments and advantages are disclosed in further detail in the following detailed description.

BRIEF DESCRIPTION OF THE DRAWINGS

The Detailed Description will be more fully understood in view of the drawings which are illustrative of specific embodiments of the invention only and are not to be construed as limiting of any aspect of the invention, and in which.

DETAILED DESCRIPTION

Rolls for use in electrophotographic development include, inter alia, a toner adder roll which applies toner to a developer roll which, in turn, transfers toner onto a photoconducting member, and a transfer roll which transfers toner from a photoconducting member to a print media. The functionality of rolls for use in electrophotographic (EP) development are well known in the printing art. An embodiment of the present invention directed to toner adder rolls incorporated into developing devices of an EP printer will now be fully explained with reference to the accompanying figures.

Figure 1:
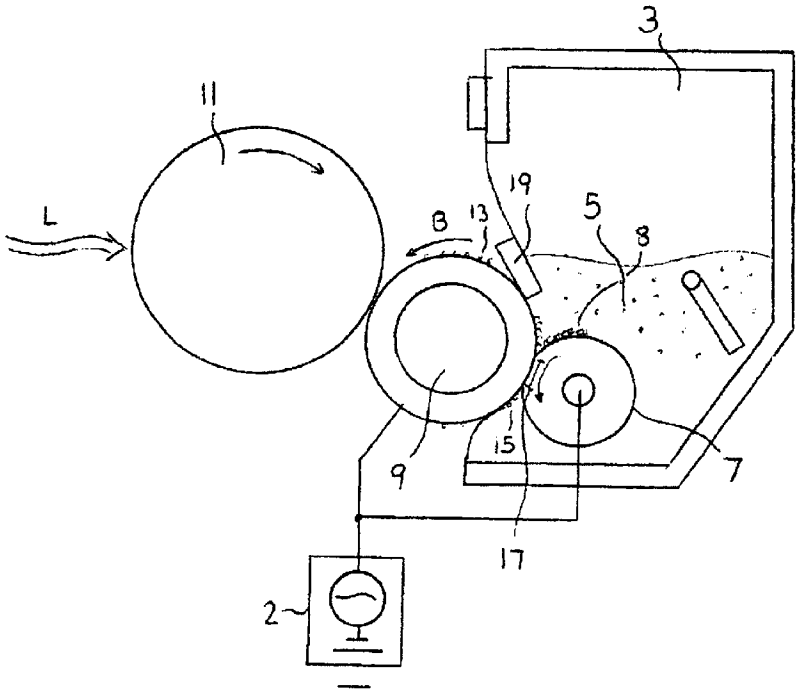
FIG. 1 is a schematic illustration showing a toner adder roll embodiment of the present invention in the context of a developing unit of a laser printer.

A color EP printer typically comprises four developing devices, one for each of the colors cyan, yellow, magenta and black. An example of one such developing device is shown in FIG. 1 and comprises a compartment 3 in which toner 5 as a color developer is contained, a toner adder roll 7, and a developing roll 9. A photosensitive drum 11 (bearing an image) is rotated in a direction shown by arrow A. An electrostatic latent image is formed on a surface of the photosensitive drum 11 by a laser beam L. The electrostatic latent image is developed as a toner image by the developing device 1 disposed in the vicinity of the photosensitive drum 11. The toner adder roll 7 and the developing roll 9 are held in rolling contact with each other under a predetermined pressure and are adapted to rotate in the same direction given by arrow B. Since the toner adder roller 7 is made of flexible polymeric material 21, the portion of the adder roller 7 in contact with the developing roll 9 forms a dented nip 17. A power source 2 supplies a predetermined bias DC voltage to the shafts of both the developing roll 9 and toner adder roll 7, generating an electric field between the two, allowing charged toner 8 on the toner adder roll 7 to be attracted to and supplied to the developing roll 9. The toner adder roll 7 scrubs residual toner 15 which remains on the outer circumferential surface of the developing roll 9, and then applies toner from the compartment 3 to the outer circumferential surface of the developing roll 9, so that a toner layer 15 is formed on a portion of the outer circumferential surface of the developing roll 9. Adjacent to the developing roll 9 and relatively near to the nip of the rolls 17, there is disposed a toner-layer forming blade 19 by which the thickness of the toner layer 15 formed on the developing roll 9 is suitably regulated. The developer roll 9 rotates so that it is brought into contact or close circumferential proximity to the photosensitive drum 11 and the toner of the toner layer 15 formed on the developing roll 9 is transferred onto the surface of the photosensitive drum 11 so that the electrostatic image on the photosensitive drum 11 is developed.

Figure 2A:
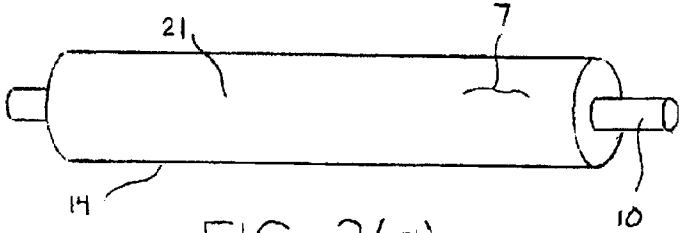
FIGS. 2(*a*), 2(*b*) and 2(*c*) are respectively a perspective view, a plane view and an end view of a toner adder roll embodiment according to the present invention.
Figure 2B:
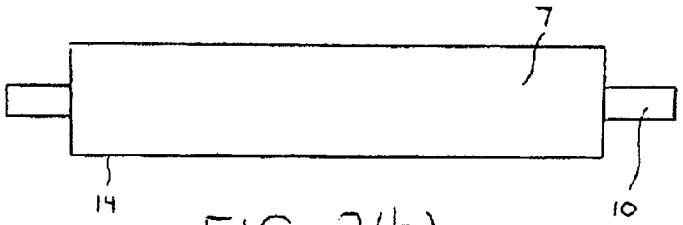
Figure 2C:
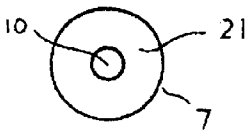

One embodiment of the present invention relates to the toner adder roll used in each developing device of an image-forming apparatus. A more specific embodiment is directed to the toner adder roll 7 used in each developing device 1 of a full color EP image-forming apparatus constructed as described above. In a specific embodiment, as shown in FIG. 2, the toner adder roll includes a metallic core shaft 10 and a polymeric foam layer 21 cylindrically disposed about the shaft 10, forming the outer circumferential surface 14 of the toner adder roll 7.

In electrophotographic applications, a toner adder roll is multi-functional with respect to the developing member of the developing device. It removes unused toner from the developing roll by effective scrubbing action on one side of the nip (the contact interface between the toner adder roll and developing roll or member). It transfers new toner from the toner-container to the developing roll. The toner adder roll also exhibits a charge differential with respect to the developer roll, and, via the contact pressure with the developing roll, triboelectrically charges the toner particles. The toner adder roll and developing roll are in contact with one another, and the toner adder roll is sufficiently compliant such that a nip of a particular width is formed at the contact surface. The contact force between the two rolls is great enough to provide conductive—maintaining friction, but not so great that the torque is undesirably increased to the point where toner fusion to the developing roll, toner degradation and/or excessive roll wear occurs. The toner adder roll is constituted of a material sufficiently flexible so as to compress at the nip, and sufficiently resilient to spring back to the substantially original circumferential circular shape when that portion of the roll is no longer in the nip area.

One embodiment of the present invention is directed to a roll for use in an image-forming apparatus comprising a polymeric foam wherein the foam exhibits a density of at least about 6 pounds per cubic foot, measured according to ASTM 3574, and a 25% compression force deflection of at least about 2.5 pounds per square inch, as measured according to ASTM 3574. In a more specific embodiment, the polymeric foam is comprised of an open-celled, non-reticulated polymeric foam. In an even more specific embodiment, the polymeric foam is comprised of an open-celled, non-reticulated polyether based or polyester based polyurethane foam.

As is well-known by those skilled in the polymer arts, cellular material having an "open-cell" structure is one in which the cells communicate with one another. Reticulated cell structure, on the other hand, is an extreme variation of an open structure wherein merely the foam skeleton or scaffolding remains. Reticulated foams are constructed such that the "windows" that separate the individual cells making up the foam structure are open and the material in the windows collapses into the "struts and beams". This is typically accomplished in an additional post-cure step using heat and pressure in a specially designed vessel, or through a chemical process. When reticulated foams are viewed under a microscope, cell membranes are absent and all that can be seen is a "tinker-toy"-like matrix. Typical reticulated, flexible polyurethane foam scaffold is formed from water insoluble polyester or polyether backbone and diisocyanates as caps to the polyols in processes well-known in the foaming arts.

Processes suitable for formulation of the open-cell, non-reticulated foam structure of the present inventive roll are also well-known in the art. The formation of any particular foam given a set of desired property parameters is also routine for foam chemists. Polyurethane foam production is based on the reaction of an isocyanate with a molecule comprising either an alcohol or amine functional group as a source of active hydrogen. To form a polyurethane polymer, di- or polyisocyanates are reacted with polyfunctional compounds, typically hydroxyls, known as polyols. Foam cell formation is based on the reactions of isocyanate with water to form an aromatic amine and carbon dioxide. The carbon dioxide causes the cell formation and foaming.

The characteristics of the finished polyurethane are dependent on the particular polyol and isocyanate chosen, and the reaction conditions under which foaming takes place. One skilled in the art of polyurethane foam chemistry can select the polyol, the isocyanate, the amount of water, the types and amounts of catalysts, surfactants and other additives to obtain the desired density, compression force deflection, pores per inch, and electrical properties of the foam.

The open cell polyurethanes of the present invention are manufactured according to a "one shot process" in which all reactants are added simultaneously at the time of foaming. This mixture is then applied to a moving conveyor where it is allowed to react and expand. Side walls on the conveyor allow the foam to rise into a bun or slab anywhere from 2 to 4 feet in height. The slab is then cut, stored and allowed to cure for 24 to 48 hours. This process of foam formation is generally known as the slabstock process. The cured foam is then fabricated into toner adder rolls by cutting a sleeve of the foam and gluing it to the toner adder roll shaft. The shafted foam is then ground to desired dimensions.

Other processes such as molding can be used to fabricate the foam, and the foam can be comprised of other than polyurethane polymers. These properties have been exemplified herein by polyurethane foams, but foams of other rubber materials such as nitrile, ethylene-propylene, ethylene-propylene-diene, styrene-butadiene, butadiene, isoprene, natural, silicone, acrylic, chloroprene, butyl and epichlorohydrin rubber, either alone or in combination, are suitable as well. In each case, however, the foams produced according to the inventive parameter profile requirements of density, compression force deflection, linear cell count, and resistivity fall within the scope of this invention. There are a number of commercial industrial foam manufacturers which can provide foams of specific physical parameters, for example, Foamex of Eddystone, Pa.

Flexibility and resiliency are mechanical characteristics of foams that are defined by the factors of density and CFD (the amount of force required to compress a foam a certain percentage of its original dimension), and an interplay between density and compression force, partly reflected by a parameter known as compression force deflection (the tendency of a substrate to "spring back" to its original form after deformation). In addition, the surface of the toner adder roll is typically comprised of adequate irregularities. These surface features enable effective scrubbing action in the removal role, and provide a contact surface effective for controlling and dissipating static electricity and maintaining the charge differential between the developing roll and toner adder roll, necessary for proper transfer of the toner.

Density and hardness are independent foam characteristics. Density is described by mass per unit volume and reported herein in pounds per cubic foot and calculated by dividing the weight of the sample by the (length(ft)×width (ft)×height(ft)). Standard density measurement techniques are reported in the Polyurethane Foam Association "Joint Industry Foam Standards and Guidelines", Section 1.0, available on-line at www.pfa.org, dated Jan. 31, 2001, and incorporated herein by reference. In one embodiment of the present inventive roll for use in an image forming apparatus, the roll comprises an open-celled, non-reticulated polymeric foam wherein the foam exhibits a density of at least about 6 pounds per cubic foot. In a more specific embodiment, the density is from about 6 to about 10 pounds per cubic foot. In a still more specific embodiment, the density is from about 7 to about 8.9 pounds per cubic foot. Finally, in a precise embodiment, the density is about 7 pounds per cubic foot.

Foam hardness, on the other hand, is generally reported in terms of compression force deflection (CFD), and foams of a given hardness can be made at varying densities. Compression force is merely the force required to compress a material a certain percentage and is expressed in pounds per square inch. In one embodiment of the present inventive roll for use in an image forming apparatus, the roll comprises an open-celled, non-reticulated polymeric foam wherein the foam exhibits a compression force deflection of at least about 2.5 pounds per square inch. In a more specific embodiment, the CFD is from about 2.5 to 4.7 pounds per square inch (psi). In a still more specific embodiment, the CFD is from about 3.0 to 4.6 psi. Finally, in a precise embodiment, the CFD is about 3.0 psi.

Pores per inch (ppi) of the foam is another standard foam physical parameter that often, though not necessarily, correlates to foam density, with higher densities exhibiting higher ppi's. While correlated to density, the two characteristics are, in fact, independent, as foams with equivalent overall densities can have different ppi measurements depending on the density of the cell walls. Conversely, foams with similar ppi measurements can have different densities reflecting this matrix density variation. In one present embodiment, the foam exhibits an average of from about 90 to about 120 pores per inch. By "average" it is meant that multiple random linear cell counts, known in the industry as "pores per linear inch" as well as "pores per inch" (ppi), taken throughout the foam will have a mean count of 90–120 ppi.

Flexible polymeric foams, in particular, polyurethane foams, act inherently as electrical resistors. Polyurethanes are strong electrical resistors and cannot be used in applications which require electrical conductivity unless they are rendered electrically dissipative or conductive by some additional agent.

Because the foam comprising the present inventive rolls is not reticulated, and therefore less porous, it is more difficult to render the foam conductive by applying conductive coatings comprising conductive agents. Thus, the use of conductive agents which can be incorporated into the foam matrix during the foam manufacturing process is more desirable. The agent is therefore substantially uniformly dispersed throughout the foam matrix. In one embodiment of the present invention, the roll comprises at least one agent substantially uniformly dispersed throughout the foam.

The toner adder rolls of the present invention may be rendered electroconductive by incorporation of a conductive agent in the foam. In the electrophotographic embodiment of the present invention, the toner adder roll must be electrically conductive. In this embodiment, a power source supplies a predetermined bias DC voltage to the shafts of both the developing and toner adder rollers. As a result, an electrical field is generated between the developing roller and the toner adder roller. Then, the charged toner particles on the toner adder roll are electrically attracted toward the developing roll, allowing toner particles from the toner adder roll to be supplied onto the developing roll.

The conductive agent can be any agent effective to adapt the foam roll for use in electrostatically sensitive image forming apparatus environments. One embodiment of the present inventive roll comprises at least one conductive agent incorporated in the foam. Non-limiting examples of suitable conductive agents include ammonium salts such as perchlorates, chlorates, hydrochlorides, bromates, iodates, borofluroides, sulfates, ethyl sulfates, carboxylates, sulfonates, etc. of any tetraethyl ammonium, tetrabutyl ammonium, dodecyltrimethyl ammonium such as lauryltrimethyl ammonium, hexadecyltrimethyl ammonium, actodecyltrimethyl ammonium such as stearyltrimethyl ammonium, benzyltrimethyl ammonium, modified aliphatic dimethylethyl ammonium, tec.; perchlorates, chlorates, hydrochlorides, bromates, iodates, borofluorodides, tribluoromethyl sulfates, sulfonates, etc. of any alkali metals such as lithium, sodium and potassium, or alkaline earth metals such as calcium and magnesium, electroconductive metal oxides such as tin oxide, titanium oxide and zinc oxide, and metals such as nickel, copper, silver and germanium. In one specific embodiment, the at least one conductive agent comprises a hexahalogentated ionic compound. In a further embodiment, the conductive agent comprises a hexahalogenated ionic compound selected from the group consisting of potassium hexafluorophosphate, sodium hexafluorophosphate, and ammonium hexafluorophosphate. In a more precise embodiment, the conductive agent comprises at least one conductive agent consisting of potassium hexafluorophosphate. The hexahalogenated ionic compounds used according to one aspect of the present invention are disclosed in U.S. Pat. No. 5,955,526 to Spicher, incorporated herein by reference. The conductive agent may be used alone or in combination with one or more other suitable agent and/or conductive agents. The amount of conductive agent is not particularly limited but, in one embodiment, should be an amount effective to confer an electrical resistivity of less than about $1\times10^{9}$ ohm-cm.

The present invention reduces a problem associated with the use of toner adder rolls developed for monochrome applications in full-color EP applications. A problem known as "fade to color" has been noted, wherein there is a band of relatively low-density print at the top of a page of solid area print. The width of the band typically corresponds to one revolution of the developing roll. Use of a toner adder roll comprised of a foam exhibiting the indicated mechanical parameters substantially reduces this problem. The pressing action of the toner adder roll against the developing roll provides effective toner supply and removal and conveyance of the toner to the developing portion of the photoconducting member without causing variation in the rotational torque of the developing roll.

EXAMPLES

Embodiments of the invention directed to toner adder rolls are manufactured according to within the inventive physical parameter specifications. The rolls are assessed for effectiveness in reducing undesirable print variation. "Undesirable print variation" is designated by level of print variation constituting a noticeable faded portion of print at the top of a printed page, observed when using a conventional toner adder roll intended for monochrome print applications in color electrophotographic print applications. Print variation and effect on print variation is determined on the basis of a non-enhanced visual inspection of the printed image on paper under standard, ambient conditions. An exemplar toner adder roll comprised of a foam exhibiting a density of about 7.0 pcf, CFD of about 3 psi, mean ppi of about 90 to about 100, and a resistivity of less than $1\times10^9$ ohm-cm, yielded a reduction in print variation. A second exemplar toner adder roll, comprised of foam exhibiting a density of about 7.9 pcf, CFD of about 3.7 psi, mean ppi of about 90 to about 100, and a resistivity of less than $1\times10^9$ ohm-cm, also yielded a reduction in print variation. A third exemplar toner adder roll, comprised of a foam exhibiting a density of about 8.9 pcf, CFD of about 4.6 psi, mean ppi of about 90 to about 100, and a resistivity of less than about $1\times10^9$ ohm-cm, substantially eliminated print variation.

One embodiment of the present invention is directed to a method for applying toner to a developing member in an EP image forming apparatus. The method comprises applying the toner via a roll comprising an open-celled, non-reticulated polymeric foam wherein the foam exhibits a density of at least about 6 pounds per cubic foot and a 25% compression force deflection of at least about 2.5 pounds per square inch. In another embodiment to this method, the polymeric foam comprises either a polyester based or polyether based polyurethane. In a more specific embodiment, the roll comprises at least one conductive agent substantially uniformly dispersed throughout the foam. In still another aspect, the foam exhibits an average of from about 90 to about 120 pores per inch. By "average" it is meant that multiple random linear cell counts, also known in the industry as "pores per linear inch" or "pores per inch" (ppi), taken throughout the foam will have a mean of 90–120 ppi. In a further embodiment, the roll exhibits an electrical resistivity of less than about $1\times10^9$ ohm-cm. Finally, one specific embodiment of the present invention is directed to a method effective to reduce print density variations in print media applications, in particular, those resulting from the aforementioned "fade to color" problem.

In one specific embodiment of the present invention, the toner adder roll for use in EP image-forming apparatuses comprises a substantially homogeneous layer of open-celled, non-reticulated polyurethane foam cylindrically disposed about a metal shaft and forming the circumferential surface of the toner adder roll, further comprising at least one conductive agent dispersed substantially uniformly throughout the foam, and wherein the foam exhibits a density of at least about 6 pounds per cubic foot, a compression force deflection of at least about 2.5 psi, an average linear cell count of from about 90 to about 120 ppi, and a resistivity of less than about $1\times10^9$ ohm-cm.

While the invention has been described in detail with reference to specific embodiments thereof, it would be apparent to those skilled in the art that various changes and modifications may be made therein without departing from the spirit of the invention, the scope of which is defined by the following claims.

What is claimed is:

1. A roll for use in an image-forming apparatus comprising a polymeric foam wherein the foam exhibits a density of at least about 6 pounds per cubic foot and a compression force deflection of at least about 2.5 pounds per square inch.

2. The roll as recited in claim 1 wherein the polymeric foam comprises an open-celled, non-reticulated polymeric foam.

3. The roll as recited in claim 1 wherein the polymeric foam comprises either a polyether based or polyester based polyurethane.

4. The roll as recited in claim 1 wherein the density is from about 6.0 to about 10 pounds per cubic foot, and the compression force deflection is from about 2.5 to about 5.7 pounds per square inch.

5. The roll as recited in claim 1 wherein the density is from about 7.0 to about 8.9 pounds per cubic foot, and the compression force deflection is from about 2.5 to about 4.7 pounds per square inch.

6. The roll as recited in claim 1 wherein the density is about 8.9 pounds per cubic foot, and the compression force deflection is about 4.6 pounds per square inch.

7. The roll as recited in claim 1 wherein the foam is cylindrically disposed about a core shaft, and is substantially homogeneous.

8. The roll as recited in claim 7 wherein the foam forms the outer surface of the roll.

9. The roll as recited in claim 7 wherein the core shaft is metallic.

10. The roll as recited in claim 1 comprising at least one agent substantially uniformly dispersed throughout the foam.

11. The roll as recited in claim 10 wherein the at least one agent comprises a conductive agent.

12. The roll as recited in claim 11 wherein the conductive agent comprises a hexahalogenated ionic compound.

13. The roll as recited in claim 12 wherein the hexahalogenated ionic compound is selected from the group consisting of potassium hexafluorophosphate, sodium hexafluorophosphate, and ammonium hexafluorophosphate.

14. The roll as recited in claim 13 wherein the hexahalogenated ionic compound is potassium hexafluorophosphate.

15. The roll as recited in claim 1 wherein the foam exhibits an average linear cell count of from about 90 to about 120 pores per inch.

16. The roll as recited in claim 1 exhibiting an electrical resistivity of less than about $1\times10^9$ ohm-cm.

17. An image-forming apparatus comprising a roll as recited in claim 1.

18. A toner adder roll for use in an electrophotographic image-forming apparatus comprising a substantially homogeneous layer of open-celled, non-reticulated polyurethane foam cylindrically disposed about a metal shaft, further comprising at least one conductive agent dispersed substantially uniformly throughout the foam, and wherein the foam exhibits a density of at least about 6.0 pounds per cubic foot, a compression force deflection of at least about 2.5 pounds per square inch, an average linear cell count of from about 90 to about 120 pores per inch, and a resistivity of less than about $1\times10^9$ ohm-cm.

19. An electrophotographic image-forming apparatus comprising a roll as recited in claim 18.

20. A method for applying toner to a developing member in an electrophotographic image-forming apparatus, comprising applying the toner via a roll comprising a polymeric foam wherein the foam exhibits a density of at least about 6.0 pounds per cubic foot and a compression force deflection of at least about 2.5 pounds per square inch.

21. The method as recited in claim 20 wherein the polymeric foam comprises an open-celled, non-reticulated polymeric foam.

22. The method as recited in claim 20 wherein the polymeric foam comprises either a polyether based or polyester based polyurethane.

23. The method as recited in claim 20 wherein the roll comprises at least one conductive agent substantially uniformly dispersed throughout the foam.

24. The method as recited in claim 20 wherein the foam exhibits an average of from about 90 to about 110 pores per inch.

25. The method as recited in claim 20 wherein the roll exhibits a resistivity of less than about $1\times10^9$ ohm-cm.

* * * * *

UNITED STATES PATENT AND TRADEMARK OFFICE
Certificate

Patent No. 6,813,470 B1 Patented: November 2, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Donald L. Elbert, Lexington, KY (US); Michelle K. Morris, Lexington, KY (US); and Joseph Lovette, Earleville, MD (US).

Signed and Sealed this Fourteenth Day of August 2012.

WALTER LINDSAY
*Supervisory Patent Examiner*
Art Unit 2852
Technology Center 2800